US006494594B1

(12) United States Patent
Schroetter

(10) Patent No.: US 6,494,594 B1
(45) Date of Patent: Dec. 17, 2002

(54) DECORATIVE LIGHT MOUNTING APPARATUS

(76) Inventor: Joseph Schroetter, 436 Camellia La., Appleton, WI (US) 54915

( * ) Notice: Subject to any disclaimer, the term of this patent is extended or adjusted under 35 U.S.C. 154(b) by 0 days.

(21) Appl. No.: 09/879,606

(22) Filed: Jun. 12, 2001

(51) Int. Cl.[7] ..... F21V 21/00; F21V 19/06

(52) U.S. Cl. ..... 362/249; 362/806; 362/396

(58) Field of Search ..... 248/110, 111, 248/112, 113, 74.2, 48.1, 74.1; 362/147, 145, 226, 806, 249, 252, 227, 152, 151, 396; 52/11

(56) References Cited

U.S. PATENT DOCUMENTS 3,584,795 A * 6/1971 Baird ..... 362/396
3,599,916 A * 8/1971 Szabo ..... 248/73
4,121,798 A * 10/1978 Schumacher et al. ..... 248/113
4,609,171 A * 9/1986 Matsui ..... 248/74.3
4,852,832 A 8/1989 Delaney
4,901,212 A 2/1990 Prickett
5,067,061 A 11/1991 Prickett
5,121,894 A * 6/1992 Twork, Sr. et al. ..... 248/316.7
5,141,192 A * 8/1992 Adams ..... 248/231.8
5,311,414 A 5/1994 Branham. Sr.
5,607,230 A * 3/1997 Protz, Jr. ..... 362/396
5,639,049 A * 6/1997 Jennings et al. ..... 248/74.2
5,816,687 A 10/1998 Tapp
5,823,655 A 10/1998 Brooks
5,848,838 A 12/1998 Presta
6,050,709 A 4/2000 Hastings
6,338,460 B1 * 1/2002 Rumpel ..... 248/229.16

* cited by examiner

*Primary Examiner*—Alan Cariaso
*Assistant Examiner*—Sharon Payne
(74) *Attorney, Agent, or Firm*—Dale J. Ream

(57) ABSTRACT

A mounting apparatus for supporting a string of ornamental lights of the type having a length of electrical wiring, a plurality of bulb sockets therealong, and a plurality of light bulbs inserted in the sockets. The mounting apparatus includes a plurality of retaining members, each retaining member including a configuration complementary to a configuration of an upper lip of an expanse of guttering for releasable attachment thereto. A clamp member is attached to a front side of each retaining member. Each clamp member includes a pair of legs having free ends biased toward one another and selectively movable away from one another when electrical wiring of a light string is urged therebetween. In another embodiment, each clamp member is attached to a mounting plate for flush mounting to a flat surface with fasteners. In another embodiment, each clamp member is attached to an offset bracket for attachment to siding.

11 Claims, 5 Drawing Sheets

DECORATIVE LIGHT MOUNTING APPARATUS

BACKGROUND OF THE INVENTION

This invention relates to light mounting systems and, more particularly, to a light mounting apparatus for supporting decorative lights upon the outside of a home or building.

Strings of small or miniature decorative lights are frequently positioned along roof edges or around window and door frames. These light strings typically include a length of electrical wire, a plurality of bulb sockets spaced apart and connected to the wires, and a plurality of weatherproof lights inserted into the bulb sockets. Various devices have been proposed in the art for mounting decorative lights to a house or other building. Although assumably effective for their intended purposes, many light mounting systems include molded fasteners that are permanently attached to a house structure with nails or screws that leave unsightly damage if removed.

Therefore, it is desirable to have a light mounting apparatus which may be removably mounted to a gutter or other trim structure for supporting a string of decorative lights. Further, it is desirable to have a light mounting apparatus which includes a clamp that is easy to operate for receiving the electrical wires of a string of ornamental lights. Finally, it is desirable to have a light mounting apparatus which may remain unobtrusively mounted year round.

SUMMARY OF THE INVENTION

A decorative light mounting system according to the present invention for supporting a string of lights on a house or other structure includes a plurality of retaining members with each retaining member having a clamp member. In one embodiment, each retaining member includes a configuration substantially similar to a configuration of the upper lip of conventional rollform S-shaped guttering. Each retaining member is dimensioned to be releasably coupled to the upper lip of the gutter in a snap-fit relationship. Each retaining member includes a front surface to which a clamp member is attached. Each clamp member includes a pair of legs that are biased toward one another. One of the clamp legs includes a tab which, when depressed by a user, urges the clamp legs apart so that the wires of a light string may be inserted therebetween.

Another embodiment of the mounting apparatus includes the clamp member described above attached to a flat mounting plate having a generally rectangular configuration and defining at least one aperture such that the mounting plate may be attached to a flat surface with nails or screws. This embodiment combines the unique clamp construction with a more conventional mounting plate. Yet another embodiment of the mounting apparatus includes a mounting bracket to which the clamp described above is attached. The mounting bracket includes an offset configuration having a flange extending along an upper edge of a back plate thereof such that the mounting bracket may be releasably coupled to the upper edge of a lower portion of a piece of siding without the use of any fasteners.

Therefore, a general object of this invention is to provide a mounting apparatus for supporting decorative lights on a house or building.

Another object of this invention is to provide a mounting apparatus, as aforesaid, having retaining members which selectively may be permanently or temporarily attached to a gutter or eaves trough.

Still another object of this invention is to provide a mounting apparatus, as aforesaid, which may be manufactured in elongate strips from which individual retaining or mounting members may be selectively removed.

Yet another object of this invention is to provide a mounting apparatus, as aforesaid, in which a clamp for receiving the wires of a decorative light string is attached to each retaining or mounting member.

A further object of this invention is to provide a mounting apparatus, as aforesaid, in which each clamp includes a pair of legs biased toward one another with a tab extending from one leg which urges the legs apart when depressed.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
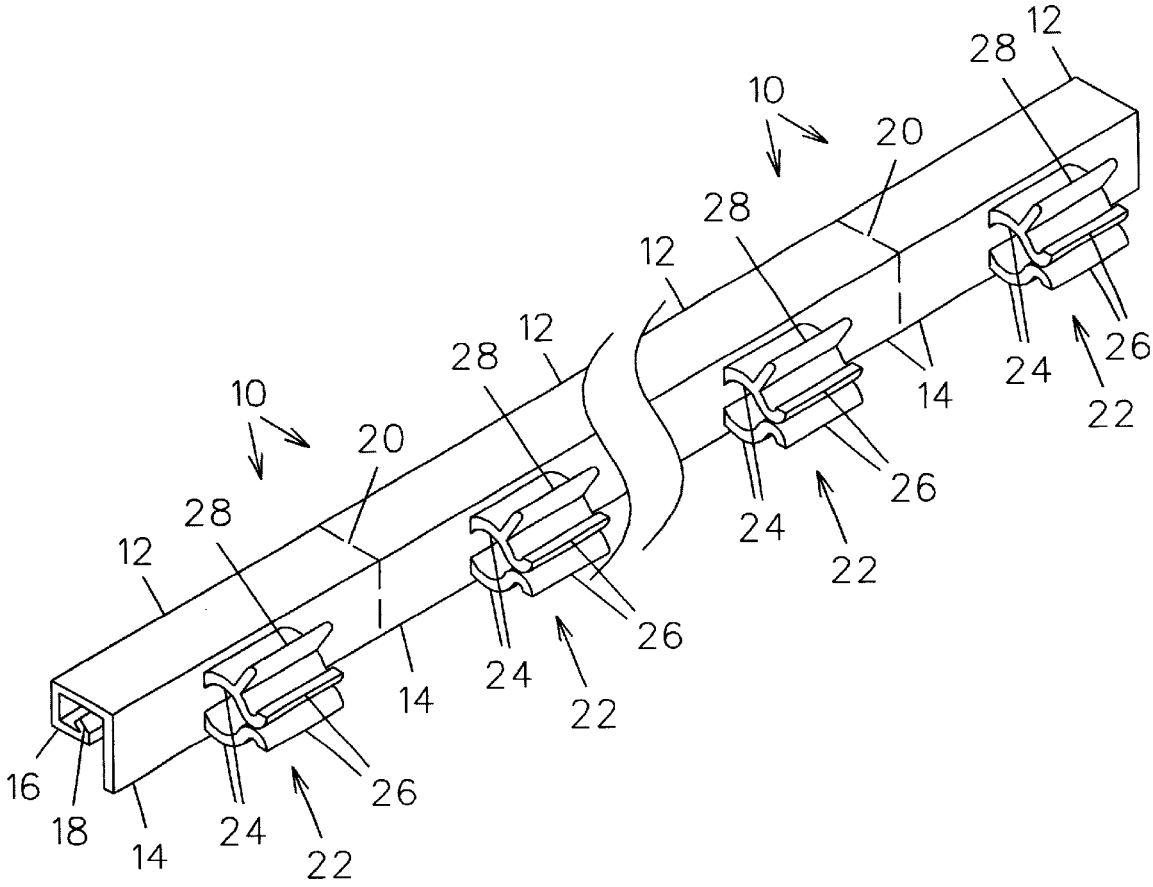
FIG. 1 is a perspective view of a mounting apparatus according to one embodiment of the present invention with the retaining members initially connected in an end-to-end configuration.
Figure 2:
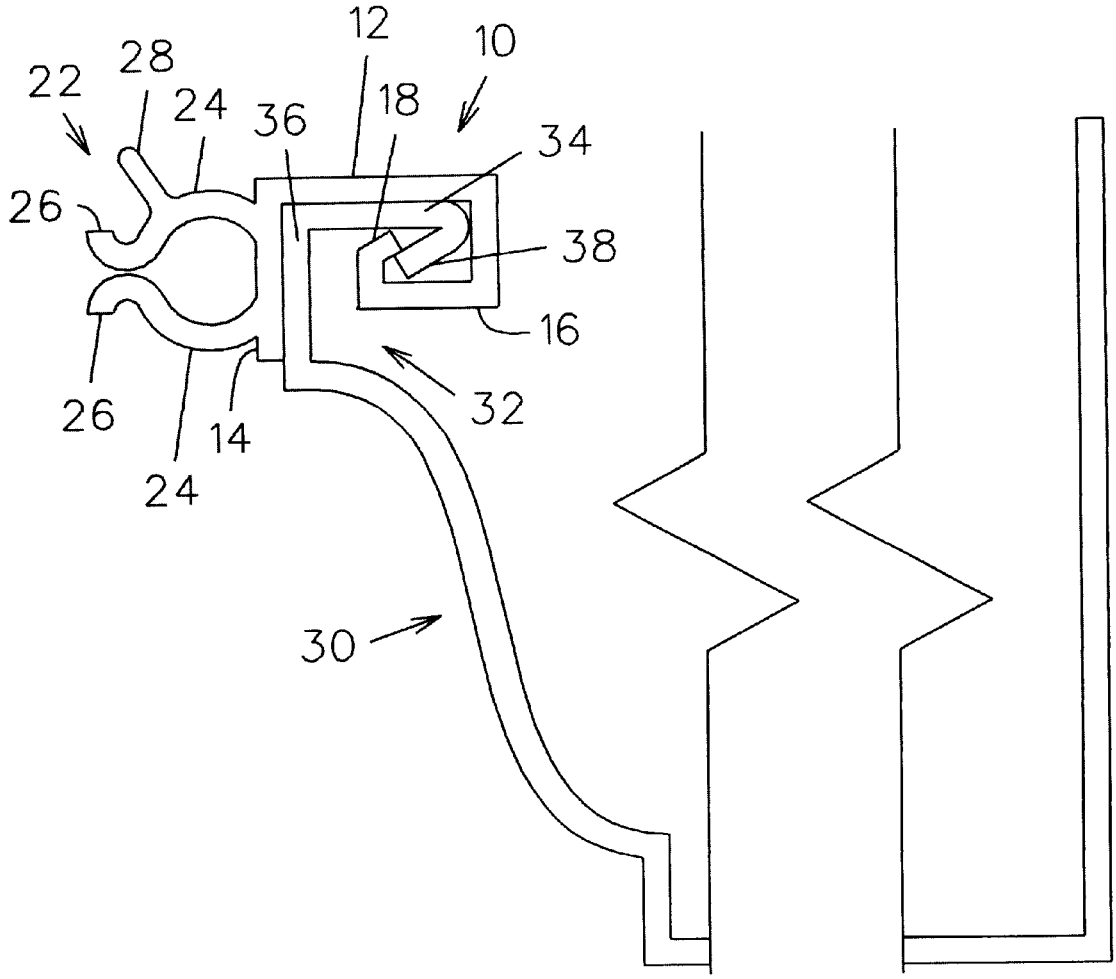
FIG. 2 is an end view of a retaining member as in FIG. 1 coupled to a rollform S-shaped gutter.

A mounting apparatus according to the present invention will now be described in detail with reference to FIGS. 1 through 5 of the accompanying drawings. One embodiment of the present invention includes a plurality of retaining members 10, each retaining member having a configuration complementary to a configuration of an upper lip portion 32 of a conventional rollform S-shaped gutter 30, also referred to as an eaves trough. More particularly, each retaining member 10 includes a top side 12 having a generally rectangular configuration (FIG. 1). Each retaining member 10 further includes a generally rectangular front side 14 normal to the top side 12. The top 12 and front 14 sides of a retaining member 10 are configured to rest atop and bear against the top 34 and front 36 sides, respectively, of a gutter upper lip portion 32 (FIG. 2). Each retaining member 10 further includes a generally L-shaped flange 16 depending from the top side 12 thereof for selectively mating with an inwardly extending hook member 18 of the upper lip portion 32. The L-shaped flange 16 may itself include a hook member 18 adapted to mate tightly with the hook member 18 of the gutter upper lip portion 32 (FIG. 2). It should be appreciated that the dimensions of each retaining member 10 are slightly greater than the dimensions of a gutter upper lip portion 32 such that the retaining member may be coupled thereto in a snap-fit relationship.

The plurality of retaining members 10 may be manufactured as an elongate strip such that a longitudinal end of one retaining member is connected to a longitudinal end of a next consecutive member. The strip of retaining members 10 includes perforations 20 at respective longitudinal ends such that individual retaining members may be consecutively broken off or cut off for individual use. Preferably, the retaining members 10 are molded out of a durable plastic material.

A clamp member 22 is fixedly attached to the front side 14 of each retaining member (FIG. 1). Each clamp member 22 includes a pair of legs 24 with each leg having a generally S-shaped configuration. Each pair of clamp legs 24 includes respective free ends that are biased toward one another yet have end edges 26 that are directed away from each other. The configuration of the end edges 26 provides a channel for receiving the wires of a light string to be held by the clamp member 22.

A tab 28 is integrally attached to one leg of each pair of legs 24 and extends outwardly therefrom. A depression of the tab 28 toward the respective retaining member 10 by a finger or thumb of a user causes the leg on which the tab 28 is attached to move away from the other leg. Thereby, the clamp member 22 is opened to allow electrical wires to be inserted therein.

In use, a user may transport a strip of retaining members 10 to the location where it is desired to display a string of lights, such as to the edge of a roof along which extends a rollform S-shaped gutter, or an eaves trough having a substantially similar construction. Retaining members 10 are consecutively broken or cut from the strip and snappably coupled at spaced apart locations to the upper lip portion 32 of the gutter 30. A decorative light string of the type having a length of electrical wiring, a plurality of bulb sockets operatively connected to the electrical wiring at spaced locations therealong, and a plurality of light bulbs removably inserted in respective bulb sockets may be supported by the mounting apparatus. More particularly, the tabs 28 on respective clamp legs 24 may be depressed toward corresponding retaining members 10 and the electrical wires of the light string may be inserted between respective pairs of clamp legs 24. When the decorative light string is no longer needed, the clamps may again be opened by properly depressing respective tabs 28 and the electrical wires may be removed. The retaining members 10 themselves may selectively be left attached to the gutter 30 or snappably removed.

Figure 3:
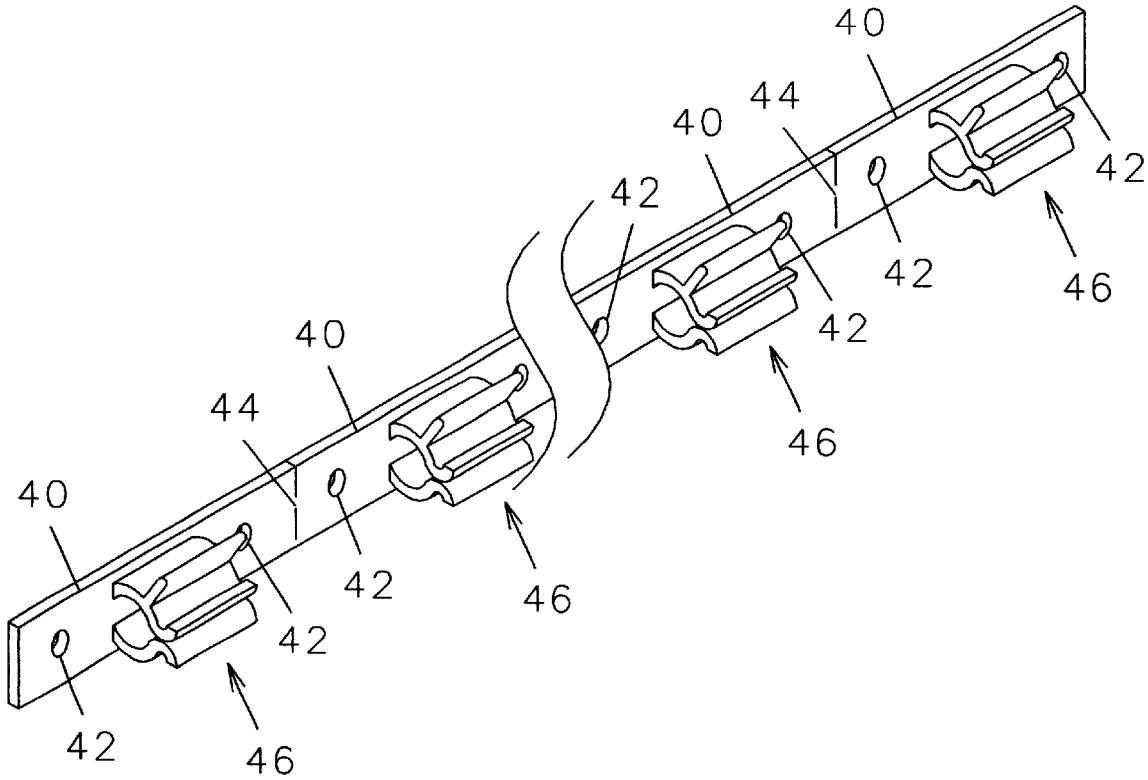
FIG. 3 is a perspective view of a mounting apparatus according to another embodiment of the present invention with the mounting plates initially connected in an end-to-end configuration.

An alternative embodiment of the mounting apparatus is shown in FIG. 3 and includes a plurality of mounting plates 40. Each mounting plate 40 includes a rectangular flat configuration and defines at least one aperture 42 through which a nail, screw, or other similar fastener may be used to mount the plate to a house or building surface, such as the siding. Preferably, each plate defines a pair of spaced apart apertures for secure mounting of the mounting plate 40. The mounting plates 40 may be manufactured and initially provided as an elongate strip with the plates in an end-to-end configuration separated by perforations 44. A clamp 46 having a configuration substantially similar to that described previously is mounted to each mounting plate 40.

Figure 4:
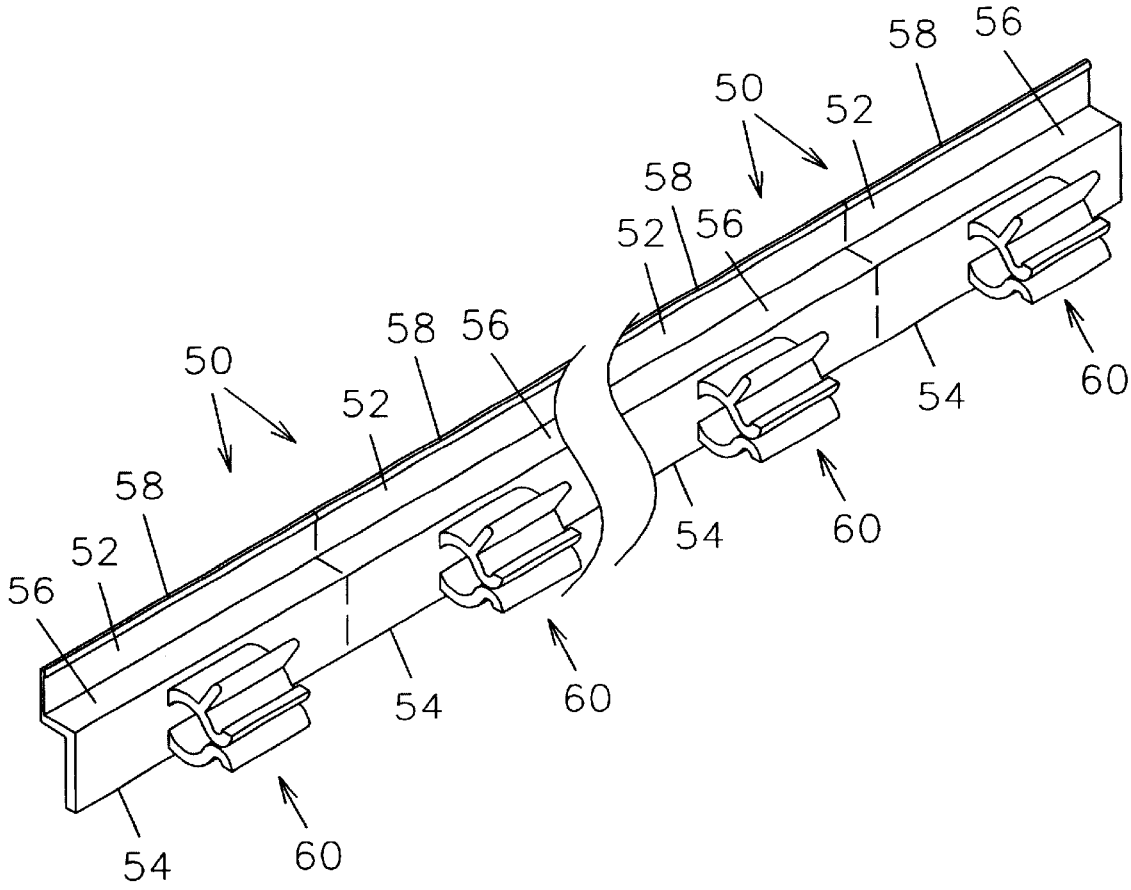
FIG. 4 is a perspective view of a mounting apparatus according to still another embodiment of the present invention with mounting brackets initially connected in an end-to-end configuration.
Figure 5:
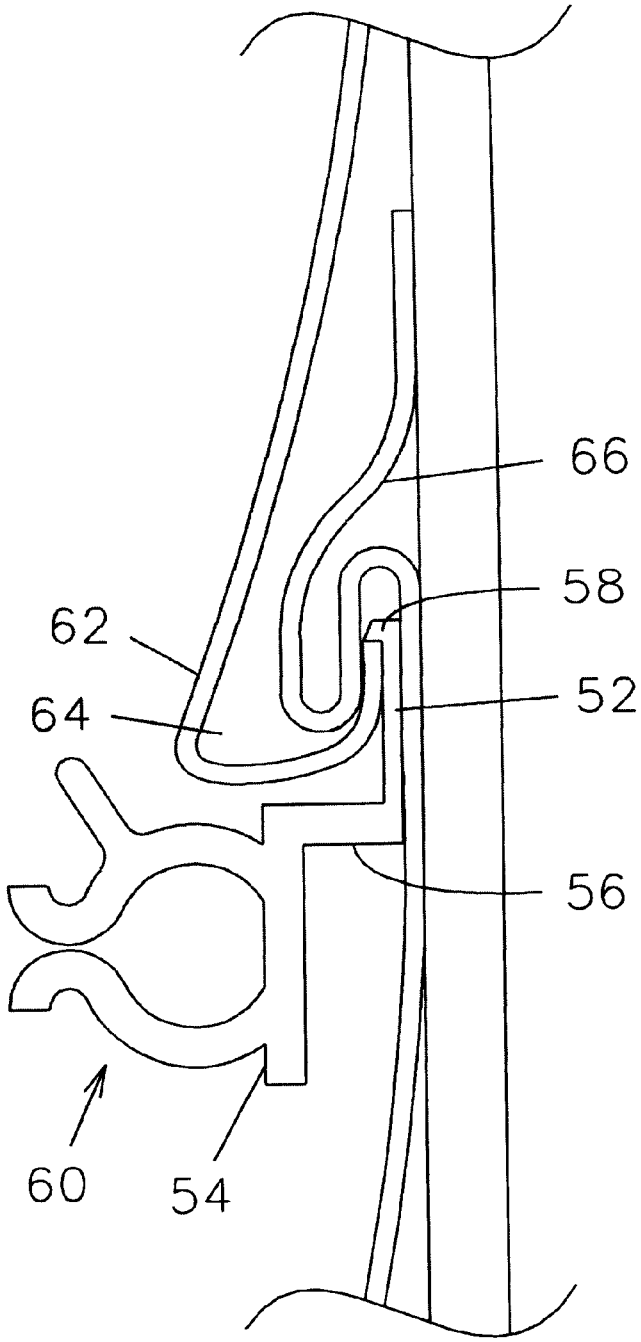
FIG. 5 is an end view of a mounting bracket as in FIG. 4 coupled to a piece of siding.

Another alternative embodiment of the mounting apparatus is shown in FIGS. 4 and includes a plurality of mounting brackets 50 suitable for attachment to artificial siding. More particularly, each mounting bracket 50 includes an elongate rectangular back plate 52 and a front plate 54 positioned parallel to the back plate 52 and having a configuration substantially similar to that of the back plate 52. A flat bridge 56 extends between a lower longitudinal edge of the back plate 52 and an upper longitudinal edge of the front plate and is normal to the front and back plates such that the front plate 54 is forwardly offset from the back plate 52. A flange 58 extends longitudinally along the free longitudinal edge of the back plate 52 and is adapted to mate with a lower portion 62 of a piece of siding (FIG. 5). Artificial siding is traditionally formed in pieces for interlocking engagement. A lower portion 62 of a siding piece includes a hook configuration that defines an interior cavity 64. An upper portion 66 of a piece of siding is configured to interlockingly engage the interior cavity 64 of an adjacent lower portion 62. In the FIG. 5 embodiment of the present invention, the back plate 52 of a mounting bracket 50 may be inserted between the upper 66 and lower 62 portions of overlapping siding pieces until the flange 58 rests atop a free edge of the lower portion hook configuration (FIG. 5). A clamp 60 having a construction substantially similar to the clamps 22 described previously is fixedly attached to the front plate 54 of each mounting bracket 50.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A decorative light mounting apparatus for supporting a string of ornamental lights having a length of electrical wiring, a plurality of bulb sockets operatively connected to said electrical wiring at spaced apart locations therealong, and a plurality of light bulbs removably inserted in said bulb sockets, said mounting apparatus comprising:

a plurality of retaining members, each retaining member having a configuration complementary to a configuration of an upper lip of an expanse of guttering and adapted to releasably mate with said upper lip;

a clamp member fixedly attached to a front side of each retaining member, each clamp member including a pair of legs having respective free ends biased toward one another, said free ends being movable away from one another when the wires of a string of lights are urged therebetween; and wherein said plurality of retaining members are initially attached to one another with perforate connections at respective longitudinal ends, whereby to form an elongate retaining strip from which consecutive retaining members may be selectively detached by a user.

2. The mounting apparatus as in claim 1 wherein each retaining member comprises:

a top side normal to said front side and adapted to rest atop a top side of said upper lip of said guttering; and a generally L-shaped flange depending from said top side of said retaining member and adapted to releasably mate with a hook portion depending from said top side of said upper lip of said guttering, each retaining member dimensioned to engage said upper lip of said guttering in a snap-fit relationship.

3. The mounting apparatus as in claim 1 wherein each clamp member includes a tab fixedly attached to one of said pair of legs, said tab adapted to urge said one of said pair of legs away from a corresponding leg upon user depression of said tab.

4. The mounting apparatus as in claim 1 wherein each of said pair of legs of a respective clamp member includes a generally S-shaped configuration in which corresponding free ends are directed away from one another so that an ornamental light string may be urged therebetween.

5. The mounting apparatus as in claim 1 wherein said guttering is rollform S-shaped guttering.

6. A decorative light mounting apparatus for supporting a string of ornamental lights having a length of electrical wing, a plurality of bulb sockets operatively connected to said electrical wiring at spaced apart locations therealong, and a plurality of light bulbs removably inserted in said bulb sockets, said mounting apparatus comprising:

a plurality of mounting plates, each mounting plate having a generally flat rectangular surface defining at least one aperture therethrough such that each mounting plate may be coupled to a flat surface with a fastener;

a clamp member fixedly attached to each mounting plate, each clamp member including a pair of legs having respective fire ends biased toward one another, said free ends being movable away from one another when the wires of a string of lights are urged therebetween; and wherein said plurality of mounting plates are initially attached to one another in an end-to-end configuration with perforate connections between respective ends, whereby to form an elongate mounting strip from which consecutive mounting plates may be detached by a user.

7. The mounting apparatus as in claim 6 wherein each clamp member includes a tab fixedly attached to one of said pair of legs, said tab adapted to urge said one of said pair of legs away from a corresponding leg upon user depression of said tab.

8. The mounting apparatus as in claim 6 wherein each of said pair of legs of a respective clamp member includes a generally S-shaped configuration in which corresponding free ends are directed away from one another so that an ornamental light string may-be urged therebetween.

9. A decorative light mounting apparatus for supporting a string of ornamental lights having a length of electrical wiring, a plurality of bulb sockets operatively connected to said electrical wiring at spaced apart locations therealong, and a plurality of light bulbs removably inserted in said bulb sockets, said mounting apparatus comprising:

a plurality of mounting brackets, each mounting bracket having a back plate, a front plate parallel to said back plate, and a bridge connecting an upper longitudinal edge of said front plate with a lower longitudinal edge of said back plate, said bridge being normal to said front and back plates and causing said front plate to be forwardly offset relative to said back plate;

each bracket including a flange extending along an upper longitudinal edge of said back plate adapted to releasably mate with a lower edge of a piece of siding; and a clamp member fixedly attached to each front plate, each clamp member having a pair of legs having respective free ends biased toward one another, said free ends being movable away from one another when the wires of a string of lights are urged therebetween.

10. The mounting apparatus as in claim 9 wherein each clamp member includes a tab fixedly attached to one of said pair of legs, said tab adapted to urge said one of said pair of legs away from a corresponding leg upon user depression of said tab.

11. The mounting apparatus as in claim 9 wherein each of said pair of legs of a respective clamp member includes a generally S-shaped configuration in which corresponding free ends are directed away from one another so that an ornamental light string may be urged therebetween.

* * * * *